United States Patent [19]

Harmon et al.

[11] Patent Number: 4,533,810

[45] Date of Patent: Aug. 6, 1985

[54] START CIRCUIT FOR MICROWAVE OVEN

[75] Inventors: Larry R. Harmon, Louisville; John C. Reiche, Middletown; Howard R. Bowles; Norman H. Chiu, both of Louisville, all of Ky.

[73] Assignee: General Electric Company, Louisville, Ky.

[21] Appl. No.: 642,567

[22] Filed: Aug. 20, 1984

[51] Int. Cl.[3] ..... H05B 6/68

[52] U.S. Cl. ..... 219/10.55 B; 219/10.55 C; 307/141.4; 307/141.8; 361/196; 361/198

[58] Field of Search ..... 219/10.55 B, 10.55 C, 219/10.55 R, 509, 519; 307/141, 141.4, 141.8; 361/195, 196, 197, 198

[56] References Cited

U.S. PATENT DOCUMENTS

| | | | |
|---|---|---|---|
| 4,232,210 | 11/1980 | Oida et al. | 219/10.55 C |
| 4,345,135 | 8/1982 | Harmon | 219/10.55 B |
| 4,378,487 | 3/1983 | Maeda | 219/10.55 B |
| 4,425,490 | 1/1984 | Takeda et al. | 219/10.55 B |
| 4,481,393 | 11/1984 | Ueda | 219/10.55 B |

*Primary Examiner*—Philip H. Leung

*Attorney, Agent, or Firm*—H. Neil Houser; Radford M. Reams

[57] ABSTRACT

A start circuit arrangement for a microwave oven including a power control relay circuit which is independently responsive to a user actuable momentary start switch and to a programmed electronic controller to facilitate operation in a delay start mode. The relay circuit includes a start latch circuit, a door switch and an arm switch. User actuation of the momentary start switch sets the latch circuit. A signal from the electronic controller resets the latch circuit. The door switch is closed by closure of the oven door. The arm switch is closed by an arm signal from the electronic controller when an actual cooking cycle is to begin. The arm signal is removed upon expiration of the cooking cycle. The arm switch, start latch means and door switch are all operatively coupled to the relay such that the relay only enables energization of the power circuit for the oven when the arm switch and door switch are closed and the start latch is set. In the time delay mode, the latch is set by actuation of the start switch following entry of the operating mode and time information. At desired start time the arm signal from the controller closes the arm switch enabling energization of the source of microwave energy as well as the blower, the oven lamp, and the mode stirrer motor.

4 Claims, 3 Drawing Figures

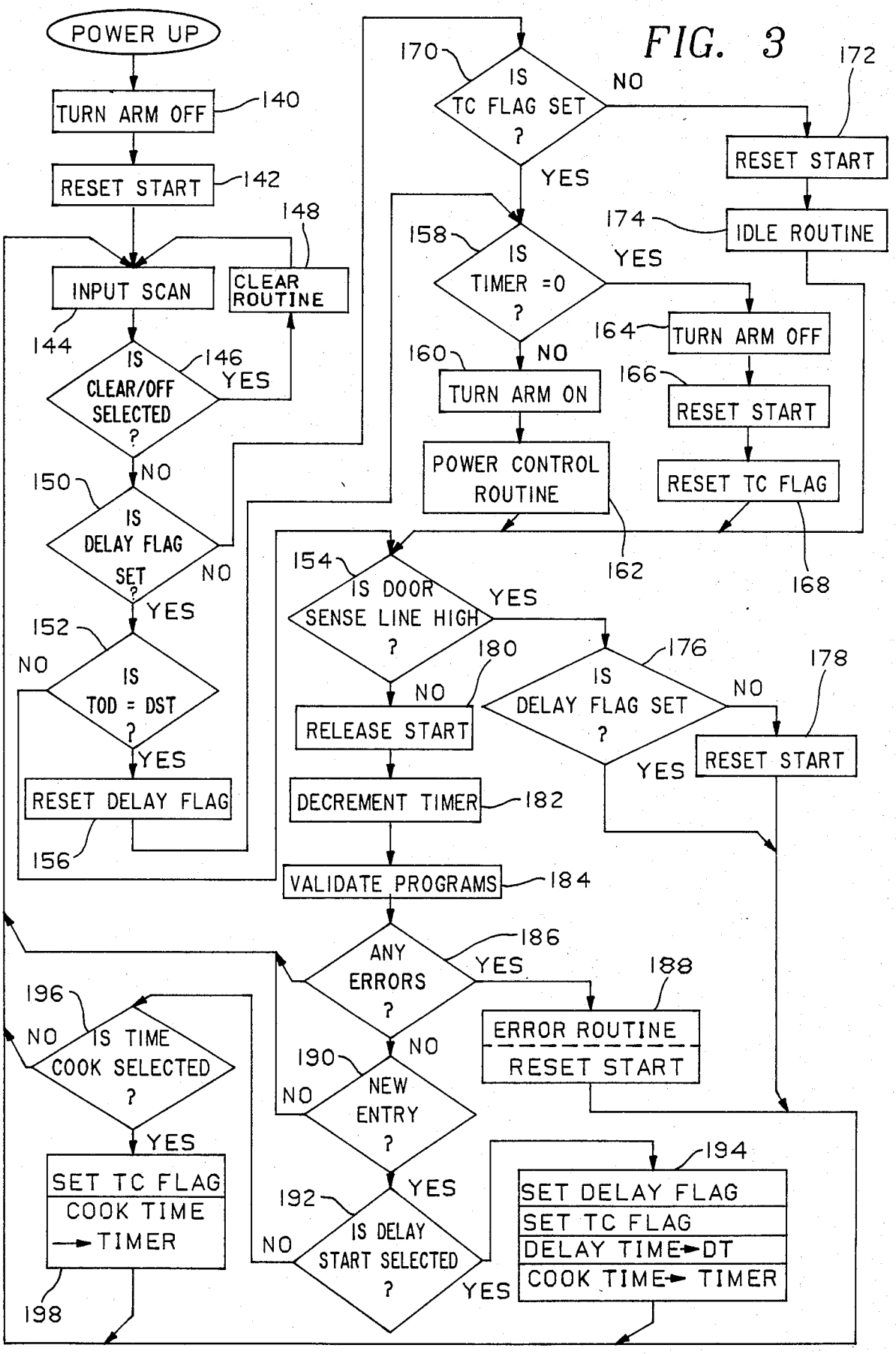
FIG. 3
POWER UP
TURN ARM OFF
140
RESET START
142
148
INPUT SCAN
CLEAR ROUTINE
144
IS CLEAR/OFF SELECTED ?
146
YES
NO
150
IS DELAY FLAG SET ?
NO
YES
152
IS TOD = DST ?
NO
YES
RESET DELAY FLAG
156
170
IS TC FLAG SET ?
NO
YES
172
RESET START
174
IDLE ROUTINE
158
IS TIMER =0 ?
YES
NO
164
TURN ARM OFF
160
TURN ARM ON
166
RESET START
POWER CONTROL ROUTINE
RESET TC FLAG
162
168
154
IS DOOR SENSE LINE HIGH ?
YES
NO
180
RELEASE START
176
IS DELAY FLAG SET ?
NO
YES
178
RESET START
DECREMENT TIMER
182
VALIDATE PROGRAMS
184
186
ANY ERRORS ?
YES
NO
188
ERROR ROUTINE
RESET START
190
NEW ENTRY ?
NO
YES
192
IS DELAY START SELECTED ?
NO
YES
194
SET DELAY FLAG
SET TC FLAG
DELAY TIME→DT
COOK TIME→ TIMER
196
IS TIME COOK SELECTED ?
NO
YES
SET TC FLAG
COOK TIME →TIMER
198

START CIRCUIT FOR MICROWAVE OVEN

BACKGROUND OF THE INVENTION

The present invention relates generally to a microwave oven of the type including a duty cycle control which periodically energizes and deenergizes the microwave generating system during the cooking process, and more particularly to an improved start circuit arrangement providing a delay start feature in such an oven.

It is common in commercially available electronically controlled microwave ovens to provide a delay start feature. Such a feature permits the microwave oven user to program the control circuitry of the oven so that a cooking operation begins at a later time. The desired delayed starting time is selected by user actuation of the appropriate touch panel keys. Typically, the user of the oven, when using the time delay feature, places the food in the oven cavity, first selects the time delay mode and enters the desired starting time for the cooking cycle, then enters the desired cooking mode or modes and the time durations for each selected mode. Following completion of entry of the time delay and cooking cycle instructions, the user then presses a start button and leaves the oven unattended.

Duty cycle control is generally utilized to control the output power of the microwave oven magnetron, resulting in the magnetron being switched between a full ON condition and a full OFF condition with the percentage of ON time being varied to change the cooking power level for the food being heated. Hence, the magnetron is a load in the oven which is energized intermittently during the cooking process. In addition, the microwave oven also includes other electrical loads which are energized continuously during the cooking process, including a magnetron cooling blower, an oven lamp and perhaps a mode stirrer motor.

Provision is usually made to control the continuously energized loads separately from the magnetron since the same switching device, which is an intermittent or duty cycle controlled device, cannot be used to control the continuously energized loads.

This presents a particular problem in providing a delay start feature. One solution to this problem is to turn on the constantly energized loads when the oven user completes entry of the delay start instructions. However, in such an arrangement these loads such as the mode stirrer motor, lamp and the blower would be energized by actuating the start button or similar input device and remain continuously energized during the delay time period when the magnetron is idle, waiting for the beginning of the cooking cycle. The obvious disadvantage of such a scheme is that power used to drive these loads is wasted during the time when they are not functionally needed to support the cooking operation. In addition noise caused by operation of these loads is undesirable and distractive.

Commonly assigned U.S. Pat. No. 4,345,135 to Larry Harmon discloses an improved delay start arrangement for a microwave oven, which utilizes a delay start relay in addition to the power control relay. The delay start relay coil is arranged to respond to the initial turn on of the magnetron by the magnetron switching element. This delay start relay, when energized, closes a holding current path for its coil to maintain it in an energized condition during the remainder of the cooking cycle. Energization of this time delay relay enables energization of the various continuously energized loads in the circuit. In the Harmon arrangement the power relay is closed by actuation of the start switch and energization of the magnetron is enabled at the beginning of the cooking cycle by trigger signals applied to the magnetron switching element from the electronic control. The time delay relay responds to the initial flow of current to the magnetron to couple the continuously energized load portion of the circuit. At the end of the cooking cycle the electronic control generates a signal to open the power relay which terminates the cooking operation and deenergizes the delay start relay.

The present invention is an improvement over the Harmon arrangement, providing a delay start capability using electronic circuitry thereby eliminating the bulky and relatively expensive delay start relay. The electronic circuitry is arranged to prevent the erroneous energization of the oven magnetron as a result of a single point failure in the electronics.

BRIEF SUMMARY OF THE INVENTION

In accordance with the invention, a start circuit arrangement is provided for a microwave oven of the type having a cooking cavity with an access door and enabling the user to select a plurality of operating modes including a time delay mode in which start of cooking cycle is delayed to a later time as selected by the user. The circuit includes an electronic controller for controlling the cyclical operation of the oven. The controller includes timing means for controlling the duration of cooking cycles and delay times in accordance with user inputs. Microwave energy is provided to the cavity by generating means adapted for selective energization by an external power supply.

A power control relay couples the microwave generating means to the external power supply. The power control relay coil circuit is responsive directly to a user actuable start switch and to the electronic controller. This relay coil circuit includes a bistable start latch circuit, a door switch and an arm switch.

The bistable start latch circuit is operative in its first state to enable energization of the power control relay coil and operative in its second state to prevent energization of the relay coil. The latch circuit is switched to its first state by user actuation of a momentary start switch coupled directly to the set input of the latch circuit, and to its second state in response to a signal from the electronic controller applied to its reset input.

The door switch is responsive to the position of the cavity access door and operative to assume a first state when the door is closed and a second state when the door is open. In its first state the door switch enables energization of the power relay coil and in its second state prevents energization of the relay coil.

The arm switch means is operative in a first state to enable energization of the power relay coil and in a second state to prevent energization of the coil. The electronic controller is operative to generate an arm signal effective to switch the arm switch to its first state to enable an actual cooking cycle at the user selected start time and to remove the arm signal upon expiration of the cooking cycle thereby switching the arm switch to its second state.

The arm switch means, start latch means, and the door switch means are all operatively coupled to the relay coil in such a fashion that the relay contacts are only closed when the arm switch, the door switch, and the start latch means each is in its first state. By this arrangement the selected time delay period is initiated following entry of the mode and time information by the user, by actuation of the momentary start switch. Closing of the cavity access door places the door switch means in its first state. Actuation of the start switch with the door closed serves to switch the latch circuit to its first state. The development of the arm signal by the controller at the selected starting time for the actual cooking cycle to begin switches the arm switch to its first state thereby causing the power relay contacts to close. Closure of the relay contacts couples the power circuit to the external power supply to energize the continuously energized loads and allow the actual cooking cycle to proceed.

A door status signal generating means provides a status signal to the electronic controller having a first state when the door switch is closed and the start latch is in its first state and a second state otherwise. The electronic controller is operative to provide a reset signal to the start latch means operative to switch the start latch to its second state in response to the door status signal switching to its second state. Hence, opening of the door when a cooking cycle is in progress switches the door status signal to its second state causing the controller to switch the latch circuit to its second state. Subsequent energization of the relay coil requires that the door be closed and that the start switch be re-actuated in order to return the start latch to its first state.

By this arrangement the power circuit, including the intermittently energized magnetron and continuously energized loads such as a blower motor, an oven lamp and a mode stirrer motor, is coupled to the external power supply by the power relay at the selected cooking start time without need for an additional electromechanical relay. Since the start latch must be in its first state for the relay contacts to be closed and in addition the arm switch must be switched to its first state by an arm signal from the electronic controller, a failure of either the latch circuit alone or the electronic controller alone will not enable energization of the power circuitry. Hence, no single point failure in the electronic circuitry will result in advertent energization of the magnetron power circuit.

BRIEF DESCRIPTION OF THE DRAWINGS

While the novel features of the invention are set forth with particularity in the appended claims, the invention both as to organization and content will be better understood and appreciated along with other objects and features thereof from the following detailed description taken in conjunction with the drawings in which:

FIG. 3 is a flow diagram of a portion of the control program incorporated in the microprocessor of the circuit of FIG. 2.

DETAILED DESCRIPTION OF THE INVENTION

Figure 1:
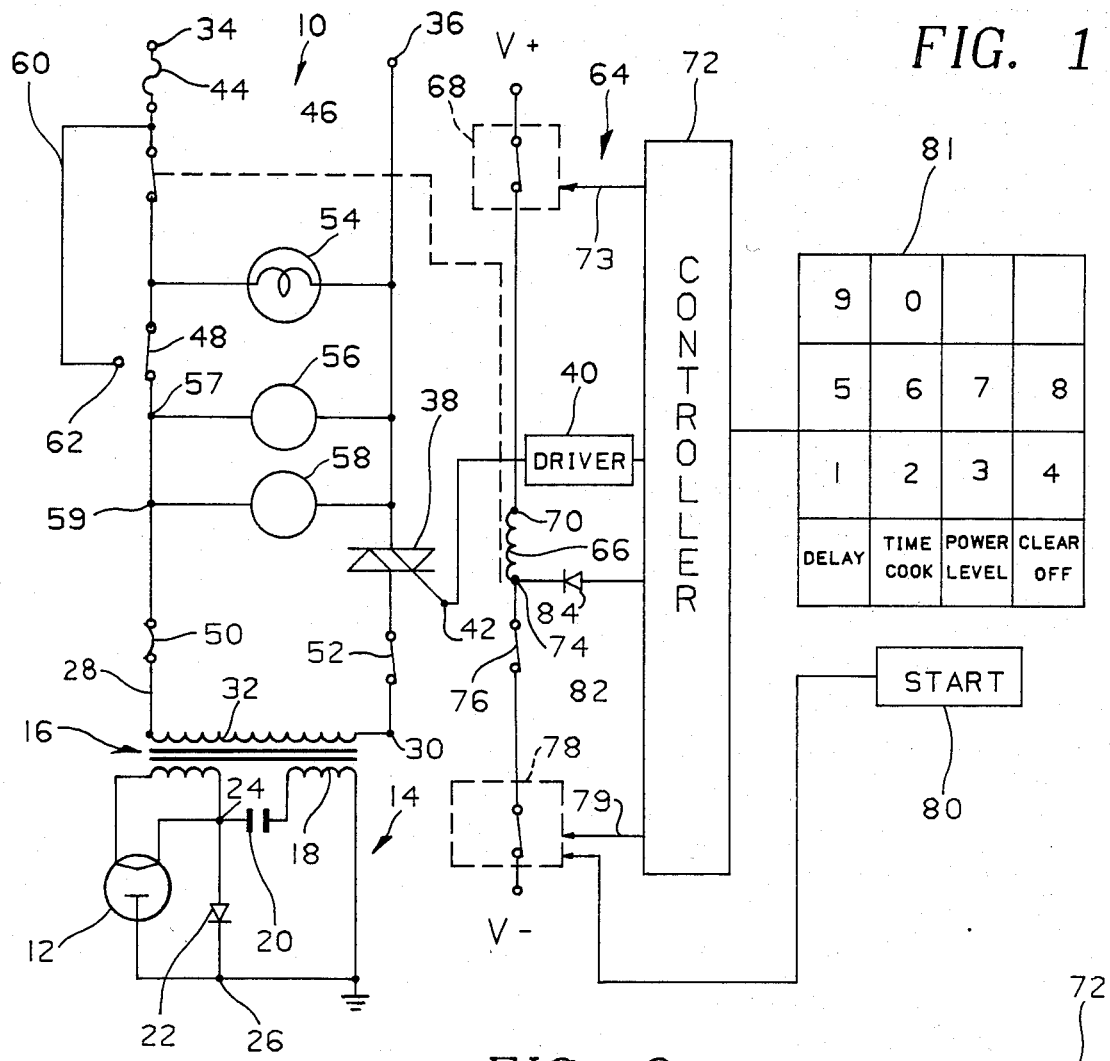
FIG. 1 is a simplified schematic circuit diagram of the microwave oven control circuit functionally illustrating the general principles of the invention.

Referring first to FIG. 1 a simplified microwave oven power control circuit 10 includes a magnetron 12 which generates microwave energy when energized from a suitable high voltage DC source. The magnetron power supply 14 includes a power transformer 16 having a high voltage secondary winding 18 connected to energize magnetron 12 through a half-wave voltage doubler comprising a series capacitor 20 and a rectifying diode 22 connected across the magnetron, anode and cathode terminals 24 and 26 respectively and oppositely poled with respect thereto.

Terminals 28 and 30 of the power transformer primary 32 are connected to terminals 34 and 36 which are adapted for connection to the L and N lines respectively of an AC power source such as a 120 volt, 20 amp, household circuit. To control the average output power of magnetron 12, a duty cycle controlled switching element 38 is interposed between power source terminal 36 and the primary winding terminal 30 to periodically energize the power transformer 16 and magnetron 12 from the AC power source. The particular duty cycle controlled switching element illustrated is a triac having suitable triggering drive circuitry 40 connected to its gate terminal 42. However, it will be apparent that other controlled switching elements may be employed such as relay contacts and cam operated switches.

Power line L is coupled to terminal 28 of the power transformer primary coil 32 through a fuse 44, a main power relay switch 46, a primary door interlock switch 48, and a thermal protector 50. Fuse 44 functions to protect the entire circuit against electrical overcurrents. The door interlock switch 48 prevents hazardous operation of the microwave oven in an open door position by ensuring that the microwave oven door is closed prior to energization of the magnetron. When the oven door is closed, switch 48 is normally in the position shown in the drawing in order to enable power to be applied to the oven. Thermal protector 50, which may be a bimetal strip or its equivalent, is positioned to measure the temperature of the magnetron interrupt power in the event of overheating. The main power relay switch 46 operates to control the cooking operation by coupling the power circuit to the AC supply when a cooking cycle is in progress and turning off the oven when the cooking cycle is completed or interrupted, such as by opening the oven door. Switch 46 is responsive to a relay coil 66 under the control of control circuitry 64 to be described in greater detail hereinafter.

Terminal 30 of primary winding 32 is coupled to a main power terminal of switching element 38 via secondary interlock switch 52. Secondary interlock switch 52 functions in the manner nearly identical to switch 48 to prevent energization of the magnetron when the microwave oven door is open. Switch 52 is opened when the door is opened and closed by closure of the oven door.

Additionally connected across the L and N power source terminals are a group of loads 54, 56 and 58 which are continuously energized during operation of the microwave oven in a cooking mode. Load 54 is an oven lamp used to illuminate the oven interior. Load 56 is a blower motor used to drive a fan to cool the electronic package. Load 58 comprises a mode stirrer motor which is used in conventional ovens to drive a conductive fan-like member adjacent the main feed input of the microwave energy into the oven cooking cavity to continuously change the mode patterns in the oven, as is well known to those skilled in the art.

Loads 56 and 58 are coupled to power terminal 34 via contacts 57 and 59 respectively. By this arrangement these loads are energized only when the door interlock switch 48 is closed and the power relay 46 is closed. However, it is desirable to have the lamp illuminating the cavity be energized when the door is opened regardless of whether the power relay is closed or not. This is achieved by conductor 60 which couples a second contact 62 for switch 48 to power terminal 34, bypassing relay switch 46. When the oven door is open switch 48 closes across terminal 62 thereby connecting lamp 54 across power terminals 34 and 36 to illuminate the cavity.

Triggering of power control switching element 38 is controlled by electronic controller 72 which is programmed to generate trigger signals in accordance with the user selected power level. These trigger signals are applied to gate terminal 42 via conventional drive circuitry 40. User input selections are communicated to controller 72 via a conventional key panel arrangement 81. Such key panel arrangements are well known in the art. Key panel 81 enables the user to select the desired operating mode or modes, the desired starting time (delay mode), the time duration (time cook mode) and the power level for the selected mode or modes. The various numbered function keys of key panel 81 are periodically scanned in a known manner by controller 72 to detect and identify actuated keys. The circuitry described thus far is of a conventional nature well known in the art.

The present invention provides an improved start circuit arrangement for controlling energization of power relay 46 switch, which arrangement facilitates operation in delay start mode with relatively inexpensive electronic circuitry eliminating the need for any additional costly and bulky electro-mechanical relay devices.

The control portion 64 of the circuit of FIG. 1 includes the power relay coil 66, which controls power relay switch 46. Relay coil 66 is coupled to the positive terminal, V+ of a DC power supply via an arm switch represented highly schematically at 68. Arm switch means 68 has a first state and a second state which in the illustrative embodiment are defined as the open and closed states respectively. Arm switch 68 is operative in its first state to enable energization of the relay coil by coupling terminal 70 of the coil to the positive DC voltage supply terminal V+. In its second state arm switch 68 prevents energization of the coil by de-coupling terminal 70 from the positive voltage terminal. The state of switch 68 is controlled by an arm switch signal developed by the electronic controller 72 and coupled to switch 68 via output line 73. Switch 68 assumes its first state in response to the arm signal from controller 72 and assumes its second state in the absence of the arm signal from controller 72. As will be hereinafter described in greater detail, controller 72 is operative to generate the arm signal at the user selected time to initiate an actual cooking cycle and to remove the arm signal from switch 68 upon expiration of user selected cooking cycle time. Removal of the arm signal opens the power relay coil circuit and hence the power circuit at the completion of the cooking cycle. In the illustrative embodiment herein described, controller 72 is a microprocessor appropriately programmed as hereinafter described to generate the arm signal and other control signals.

Terminal 74 of coil 66 is coupled to the negative DC voltage supply terminal V− via a door switch 76 and start latch circuit means represented highly schematically at 78. Door switch 76 functions in a manner similar to the hereinbefore described safety interlock switches 48 and 52. Switch 76 assumes a first state, which in the illustrative embodiment is the closed position shown, when the door is closed and a second state or open position when the door is open. Hence, opening of the door interrupts energization of power relay coil 66 effectively de-coupling magnetron 12 from the power supply.

Latch means 78 is a bistable latching circuit functionally represented for illustrative purposes in FIG. 1 as a switch. Latch means 78 is operative to couple terminal 74 of coil 66 to the negative DC supply voltage terminal V− in its first state and to de-couple terminal 74 from the negative voltage terminal effectively preventing energization of the coil in its second or reset state. Latch 78 is responsive to a reset signal developed by controller 72 on output line 79 and a set signal generated by user actuation of start switch 80. Start switch 80 is preferably a mechanical or tactile type momentary start switch which is closed to generated a set signal only during actual user actuation of the switch. Start key 80 may be located adjacent key panel 81 on the oven control panel, but in accordance with the present invention the start key is coupled directly to the power control relay coil circuit and is not scanned or otherwise electrically connected to the controller 72.

By this arrangement energization of the relay coil 66 is enabled only when the arm switch 68, door switch 76, and latch means 78 each is in its first state thereby providing a closed dc current path through coil 66. Hence, for the power relay switch 46 to close, the cavity access door must be closed, the start switch must have been actuated to set latch circuit 78, and the arm signal must be present from controller 72.

A significant advantage of this arrangement is that the control circuitry is all solid-state electronics, eliminating the need for the electro-mechanical relay customarily used in the prior art for latching purposes while at the same time preventing inadvertent energization of the power circuit as a result of a single point failure in the electronics. More specifically, since both an arm signal from microprocessor 72 and a set state for the separate latch circuit is required in order to energize the relay and since the latch circuit is only set by user actuation of the start switch independent of the microprocessor, a failure of only the latch circuit or only the microprocessor will not in itself be sufficient to allow the power relay to close.

In accordance with another aspect of the invention, a door status input signal to the controller 72 is provided on input line 82 via diode 84 which is connected between terminal 74 of the relay coil and an input port of the controller. The input signal provided on conductor 82 has a first and a second state defined in this embodiment as low and high states respectively. A low state occurs when both the start circuit latch 78 is set and the door switch 76 is in its first or closed state, pulling terminal 74 to the negative voltage level. Should switch 76 be opened or latch circuit 78 be in its second or reset state, the voltage level at 74 would be at a high level. Hence, the signal provided on line 82 assumes its first state only when both the door switch is closed and latch circuit 78 is in its first or set state.

Controller 72 is operative to apply a reset signal to latch circuit 78 via line 79 upon detection of the input signal at line 82 assuming its second state. Hence, opening of the door causes microprocessor 72 to apply a reset signal to latch 78. Consequently, to continue a cooking cycle interrupted by opening of the door, the door must be re-closed and the user must thereafter actuate the start switch to set latch circuit 78 to enable energization of the power relay coil 66.

Figure 2:
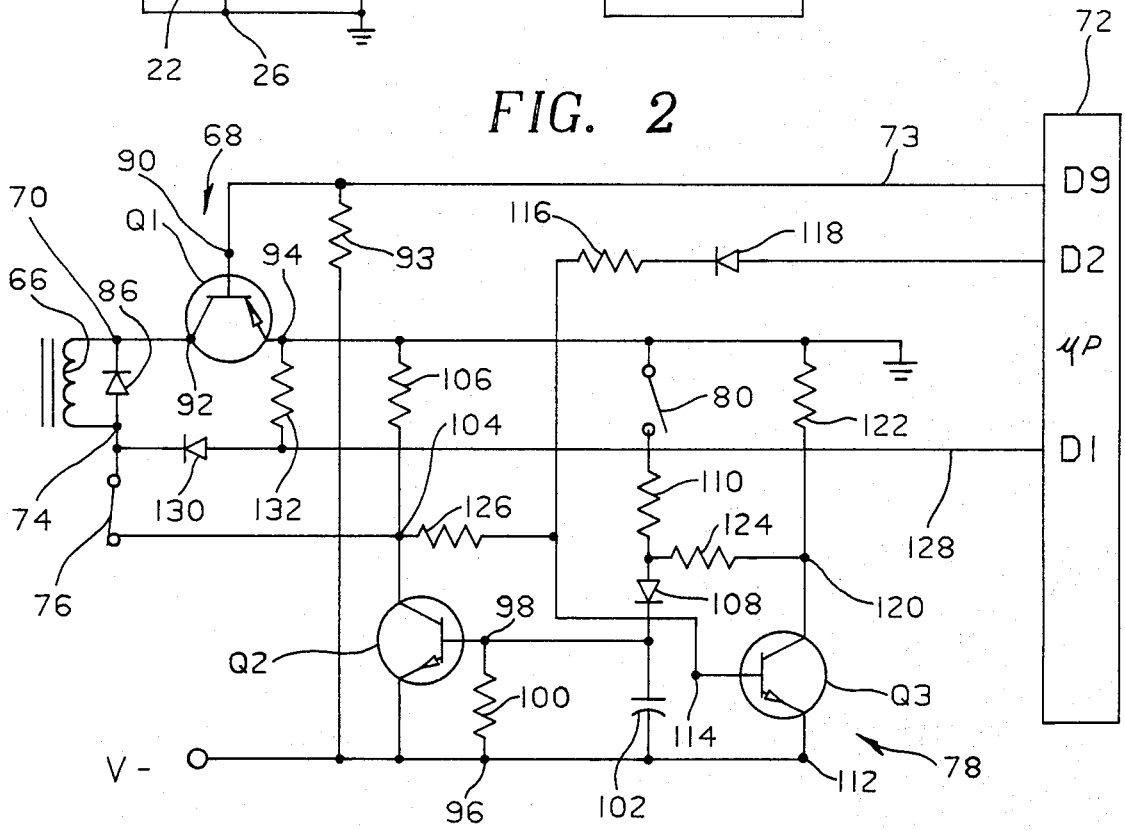
FIG. 2 is a more detailed schematic circuit diagram of the power relay coil control portion of the circuit of FIG. 1.

The power relay coil control portion of the control circuitry 64 is illustrated in greater detail in FIG. 2. Terminal 70 of power relay coil 66 is connected to the positive voltage supply, which in this embodiment is system ground, via switching transistor Q1. Opposite coil terminal 74 is coupled to negative DC voltage supply V− via door actuated mechanical switch 76 and switching transistor Q2. Hence coil 66 is energized when transistors Q1 and Q2 are in their conductive states and switch 76 is closed. Diode 86 provides a protective current path for reverse current when the field for coil 66 collapses due to opening the coil circuit.

In the illustrative embodiment transistor Q1 corresponds to arm switch means 68. Collector 92 of Q1 is connected to terminal 70 of the power relay coil 66 and the emitter 94 of Q1 is coupled to system ground which in this embodiment corresponds to the V+ supply voltage terminal of FIG. 1. The base 90 of Q1 is connected to output port D9 of microprocessor 72 via line 73. The state of Q1 is controlled by the state of an arm signal provided at output port D9 and applied to the base terminal 90 of Q1 via line 73. Output port D9 is internally configured as an open drain gate which in a first state presents a high impedance and in a second state presents a very low impedance path to system ground. In this embodiment the first or high impedance state of D9 defines the ON state of the arm signal and the second or low impedance state of D9 defines the OFF state of the arm signal. Hence when the arm signal is ON, the negative source voltage V− coupled to base 90 via bias resistor 93 is effective to turn Q1 on, i.e. conductive. When the arm signal is OFF, the low impedance state of D9 grounds the base of Q1 thereby switching Q1 to its off or non-conductive state. The arm signal is generated in accordance with control instructions stored in the internal memory of controller 72 as will be described in greater detail hereinafter.

Terminal 74 of relay coil 66 is connected to one contact of door switch 76. Door switch 76 is a conventional mechanical door interlock switch which is mechanically placed in its closed position as shown in FIG. 2 when the microwave oven door is closed and which assumes its open position when the microwave oven door is open.

Latch circuit 78 in the illustrative embodiment is essentially a bistable multi-vibrator or flip-flop circuit with transistors Q2 and Q3 as the switching devices. Emitter terminal 96 of Q2 is coupled directly to the negative DC voltage supply V−. The base terminal 98 of Q2 is coupled to the negative voltage supply via resistor 100. Filter capacitor 102 is connected in parallel with resistor 100. The collector terminal 104 of transistor Q2 is coupled to system ground via load resistor 106. Collector 104 is also coupled to the base 114 of transistor Q3 via resistor 126. Base terminal 98 of transistor Q2 is coupled to ground via diode 108, current limiting resistor 110 and user actuable momentary start switch 80.

The emitter terminal 112 of transistor Q3 is similarly coupled to the negative voltage supply V−. Base terminal 114 of transistor Q3 is coupled to output port D2 of controller 72 via current limiting resistor 116 and diode 118. The collector terminal 120 of transistor Q3 is coupled to system ground via load resistor 122. Collector 120 of transistor Q3 is connected to the base of transistor Q2 via cross coupling resistor 124 and diode 108.

The reset signal for latch circuit 78 is provided via output D2 of microprocessor 72 via diode 118 and resistor 116. Output port D2 is internally configured as an open drain gate similar to D9. When turned on, D2 presents a short circuit path to ground and when turned off, presents a high impedance. The ON state of this gate is defined as the reset signal. Hence a reset signal at D2 couples the base terminal 14 of transistor Q3 to ground via diode 118 and resistor 116 causing sufficient base current to flow to switch Q3 to its conductive or ON state. When Q3 is ON, the base current path for Q2 is shunted holding Q2 in its non-conductive or OFF state placing the latch circuit in its reset state. Base current continues to be provided to Q3 via resistors 106 and 126 following removal of the reset signal at D2 thereby holding circuit 78 in its reset state.

Latch circuit 78 is set by user actuation of momentary start switch 80. Switch 80 when closed couples the base terminal 98 of Q2 to ground via resistor 110 causing sufficient base current to flow to switch Q2 into its ON state. This results in shunting of the base current path for Q3 thereby switching Q3 to its OFF state. With Q3 OFF, base current is provided to Q2 via resistors 122 and 124 sufficient to hold Q2 in its ON state after momentary switch 80 is released.

In this fashion, user actuation of switch 80 sets the latch circuit (Q2, ON; Q3, OFF) and a reset signal at D2 resets the latch circuit (Q2, OFF; Q3, ON). In the event the user actuates start switch 80 while a reset signal is being applied, both Q2 and Q3 will assume their respective ON states. The latch circuit will subsequently be latched to the state associated with the last signal to be removed. That is, if the user releases the start switch before the reset signal is removed, circuit will thereafter remain in its reset state. Conversely, if the reset signal is removed before the start switch is released, the circuit will thereafter remain in its set state when the start switch is released.

With latch circuit 78 in its set state, switch 76 closed and transistor Q1 in its first or conductive state, a closed path is provided from the negative DC source terminal V− through Q2, switch 76, coil 66 and transistor Q1 to ground thereby energizing the relay coil and closing the power relay switch 46 (FIG. 1).

Door sense circuit means is provided in the form of a sense line 128 connecting input port D1 of controller 72 with terminal 74 of relay coil 66 via diode 130. Resistor 132 couples line 128 to system ground. When switch 76 is closed and Q2 is conductive, the voltage sensed at input port D1 via line 128 is the negative supply voltage V−. However, the opening of switch 76 removes V− from line 128 and the voltage sensed is relatively a high voltage signifying that the door is open. The microprocessor as will be hereinafter described is programmed such that upon sensing a high voltage at line 128 a reset signal is generated on line D2 resetting latch circuit 78. The arm signal, however, is not disturbed. Thus to continue a cooking cycle in progress at the time the door is opened the user merely closes the door and reactuates the start switch 80 which resets the latch and enables energization of relay power coil 66.

The following components and component values have been found suitable for use in the circuit of FIG. 2. These values and components are exemplary only and are not intended to limit the scope of the claimed invention.

| Resistors (ohms) | | Transistors | |
|---|---|---|---|
| 93 | 12K | Q1 | 2N4403 |
| 95 | 12K | Q2, Q3 | 2N4401 |
| 100 | 100K | | |
| 106 | 3.9K | Diodes | |
| 110 | 12K | 108, 130 IN 914 | |
| 116 | 12K | | |
| 122 | 3.9K | Triac | |
| 124 | 9.1K | 38 SC 147 (GE) | |
| 126 | 5.6K | | |
| | | Microprocessor | |
| | | 72 HMCS 44A (Hitachi) | |
| Capacitor | | | |
| 102 | .01 uf | | |
| DC Supply Voltage | | Relay Coil | |
| V- | −15 volts | 66 AROMAT JC1AF-DC15V-1-14 280Ω | |

Microprocessor 72 is customized to perform control functions in accordance with this invention by permanently configuring the Read Only Memory (ROM) of microprocessor 72 to implement predetermined control instructions. The primary function of microprocessor 72 relevant to the present invention is to provide an arm signal when in accordance with the user mode selections an actual cooking cycle is to begin and to remove the arm signal when the cooking cycle is to end; to generate a reset signal for resetting the start latch circuit when the oven door is opened during a cooking cycle or upon termination of a cooking cycle; and monitoring the state of the oven door switch and start latch circuit to detect when the door has been opened. For the sake of simplicity and brevity the control routine implemented by the microprocessor will be described on an essentially functional basis and only to the extent necessary to understand and appreciate the control signals relevant to the start circuit arrangement of the present invention. FIG. 3 is a flow diagram which functionally illustrates the portion of the control routine incorporated in the control program of microprocessor 72 relevant to the present invention. It should be understood that in addition to the control functions relative to the start circuit of the present invention herein described, there may be numerous additional control functions to be performed. Instructions for carrying out the routine described in the flow diagram of FIG. 3 may be interleaved with instructions and routines for these other control functions.

In a typical microprocessor controlled microwave oven appliance the control program is repetitively cycled through relatively rapidly. The control program in the illustrate embodiment is repeated every two 60 Hz line cycles. It should be noted that the control circuit is continually energized while the appliance is connected to the external power supply so that the control program for the oven is cycled through every two line cycles even if the appliance is turned off. In the oven of the illustrative embodiment the operating mode selections available to the user include a delayed start operating mode and a time cook operating mode. It will be understood that the invention as herein described is readily adaptable to ovens providing additional operating mode selections, such as a temperature cook mode, automatic defrost mode, and a hold timer mode and the user may be able to select a combination of such modes to be performed sequentially.

In the illustrative embodiment the user selects the delay start mode by actuating the delay key (FIG. 1) and entering via the number keys the time of day at which the actual cooking cycle is to begin. The user then enters the cooking parameters for the actual cooking cycle, namely the desired power level and the desired time duration in minutes, by actuating the appropriate ones of the various function and number keys on the keyboard of FIG. 1. Implementation of the selected mode is initiated by user actuation of the start key. To select the time cook mode the user merely actuates the time cook key and enters the desired power level and cook cycle duration information. With this mode selected the actual cooking begins immediately upon actuation of the start key.

Referring now to the flow diagram of FIG. 3, the program is entered at Power-Up when the appliance is plugged in to the external power supply. As part of the power-up routine, the arm signal developed at output port D9 (FIG. 2) for triggering Q1 into conduction assumes its OFF state rendering Q1 non-conductive (Block 140). A reset signal is developed at output port D2 for resetting latch circuit 78 (Block 142). A reset signal at this time insures that the power control relay coil circuit will be initially deenergized when the appliance is plugged in or power is otherwise restored such as following a power failure.

Following power-up the program enters the loop which is repetitively sequenced through until power is removed from the appliance. Early in this loop the program scans the input from the keyboard to detect user inputs (Block 144). If actuation of the clear/OFF key is detected at Inquiry 146 the program branches to a clear routine (Block 148) which performs various functions not relevant to the present invention, and the program returns to repeat the scan. If clear/OFF is not detected, Inquiry 150 determines if a delay cook mode is in progress by checking the status of the delay flag. If set, indicating a delay start mode is in progress, Inquiry 152 compares the actual time of day (TOD) with the selected delay start time (DST). The time of day information is generated in a conventional clock control routine utilized for controlling a time of day clock display. If the start time does not match the time of day, the program proceeds to Inquiry 154 to determine the status of the door sense line. If the time of day matches the desired delay time, the delay period has expired and the cooking mode is to begin. The delay flag is reset (Block 156) and the program proceeds to Inquiry 158 to determine whether the time cook cycle has timed out. Timing means for controlling the duration of the cooking cycle is provided in the form of a counter, designated TIMER, which is in effect decremented each pass through the control routine except as will be hereinafter described when the door sense line is high. A No at Inquiry 158 indicates that the time cook cycle has not timed out. The arm signal developed at output port D9 is turned on (Block 160) and a power control routine for implementing the desired duty cycle corresponding to the selected power level is then implemented (Block 162). The power control can be implemented by any number of well-known techniques for implementing a duty cycle control. The details of this power control routine form no part of the present invention.

If at Inquiry 158 TIMER equals zero indicating the time cook mode is complete, the arm signal is removed from output port D9 (Block 164), switching Q1 (FIG. 2) into its non-conductive mode preventing energization of the power relay coil. The latch circuit is reset by developing a reset signal at output port D2 (Block 166) and an internal tire cook flag (TC) is reset (Block 168).

If at Inquiry 150 the delay flag is not set, program then proceeds to Inquiry 170 to determine whether a time cook mode has been selected by checking the state of the internal time cook flag (TC). If TC is not set, this signifies that neither a delay start nor a time cook mode is in progress and the appliance is operating in the idle mode. The program resets the start latch (Block 172) and branches to an idle routine (Block 174) to perform various functions not relevant to the present invention. It will be appreciated that the "reset START" instruction could be part of the idle routine. Following the idle routine, the program branches to Inquiry 154 to sense the status of the door sense line.

The door sense line informs the microprocessor of the status of the oven door and the latch circuit. The signal at the door sense line input D1 is high when either the door is open or the latch circuit is reset. The line is low when the door is closed and the latch is set. If the door sense line is high, Inquiry 176 determines whether a delay start mode is in progress. If the delay start mode is not in progress, the start latch circuit is reset (Block 178) and the program returns back to the input scan routine to repeat the next cycle. If the delay start flag is set indicating a delay start is in progress, the start circuit is not reset. By this arrangement the user must re-actuate the start switch to resume a cooking cycle interrupted by opening of the door. Since in the delay start mode the latch circuit is not reset by opening of the door, the user need only re-close the door to continue operation in this mode. It will be apparent that since the delay start time comparison is performed each time through the program regardless of the state of the door sense line, the progress of the delay portion of the delay start mode is not affected by the status of the door.

When the door sense line is low, the reset signal at output D2 is removed (Block 180) and TIMER is decremented (Block 182). Since TIMER is only decremented when the door is closed and the start latch is set, the cook time timer is effectively suspended when the cycle is interrupted by opening of the door until the door is re-closed and the start key re-actuated. Next, a program validation routine (Block 184) is executed to insure that the most recent user entry of program selection data is correct. Inquiry 186 detects if there are any errors such as an invalid time or invalid power level entry. If so, an error routine is implemented which includes a reset start instruction which resets the start latch (Block 188). If there are no errors, Inquiry 190 determines if mode selections constitute newly entered selections. If not, the program returns to the input scan for the next cycle. If so, Inquiry 192 determines if the entry is a delay start entry. If so, the delay flag and the time cook flag are set, the selected starting time for the delayed cooking cycle is stored in memory as DT and the selected duration of the time cook is stored at TIMER (Block 194). If not, Inquiry 196 determines if the new entry is a time cook selection. If so, the time cook flag (TC) is set to selected cooking time and is stored in memory as TIMER (Block 198). The program then returns to input scan for the next cycle. If the new entry is not a time cook selection, Inquiry 196 returns the program to the input scan for the next cycle.

It will be recalled from the discussion of the latch circuit in FIG. 2 that in the event the start key is actuated by the user when a reset signal is present on line 79 both Q2 and Q3 will be switched into conduction. If while the key remains actuated the reset signal on line 79 is removed, Q3 will be rendered non-conductive, allowing Q2 to remain on after the user releases the start switch. Thus, user actuation of the start key with the oven door closed will cause Inquiry 154 to detect a low door sense line regardless of whether the reset signal is present on line 79 or not. This sensing of a low signal on the door sense line will cause the removal of the reset signal with the result that the latching circuit remains in its set state.

While in accordance with the Patent Statues, a specific embodiment of the present invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A start circuit arrangement for a microwave oven of the type having a cooking cavity with an access door, and enabling the user to select a plurality of operating modes including a time delay mode in which start of a cooking cycle is delayed by an amount of time selected by the user, said circuit comprising:

an electronic controller operative to control cyclical operation of the oven; said controller including timer means for controlling the duration of cooking cycles and delay times in accordance with user selections;

microwave generating means adapted for selective energization by an external power supply;

a power control relay operative in a first operating condition to enable energization of said microwave generating means by said external power supply and in a second operating condition to prevent energization of said microwave generating means;

a user actuable momentary start switch;

a bistable electronic start latch means operative in its first state to enable said first operating condition for said relay and operative in its second state to establish said second operating condition for said relay; said latch means including a first input coupled to said start switch and a second input coupled to said electronic controller; said latch means being operative to assume its first state in response to user actuation of said start switch and to assume its second state in response to a reset signal from said electronic controller;

a door switch operative to assume a first state when the access door is closed and a second state when the access door is open;

means for providing a door signal to said controller, said signal having a first state and a second state and said means being operative to switch said signal to its first state when the door is closed and said latch is in its first state, and to its second state otherwise;

electronic arm switch means having a first state and a second state and operative in its first state to enable said first operating condition for said relay and operative in its second state to establish said second operating condition for said relay, said arm switch means assuming its first state in response to an arm signal from said electronic controller; said controller being operative to generate said arm signal upon expiration of the user selected time delay to initiate a cooking cycle and to remove said signal upon expiration of the user selected cooking cycle time to terminate the cooking cycle;

said arm switch means, said latch means and said door switch means being operatively coupled in circuit with said relay such that said first operating condition for said relay is only established when each of said arm switch, said door switch, and said latch means is in its first state;

whereby the selected time delay period is initiated by user actuation of said momentary start switch and energization of microwave energy source is enabled by said arm signal from said controller at the expiration of the time delay period to initiate the subsequent cooking cycle.

2. A control circuit arrangement for a microwave oven of the type having a cooking cavity with an access door and means for generating microwave energy adapted for energization by an external power supply, and means enabling the user to select a time delay operating mode, said arrangement comprising:

user actuable momentary start switch means;

means responsive for generating a door signal having a first state and a second state signifying the door being in its closed and open states respectively;

an electronic controller including timer means for controlling the duration of user selected delay times and cooking cycle times and operative in response to selection of the time delay mode to generate an arm signal upon expiration of the selected time delay to initiate a cooking cycle, and to generate a reset signal when said door signal is in its second state;

door switch means operative to assume a first state when the access door is closed and a second state when the access door is open;

said door signal generating means being operative to switch said door signal to its first state only when said door switch means is in its first state;

electronic arm switch means operative to assume a first state in response to said arm signal from said electronic controller and a second state in the absence of said arm signal;

bistable electronic latch switch means responsive to said start switch reans and said electronic controller and operative to assume its first state in response to user actuation of said start switch and to assume its second state in response to said reset signal from said electronic controller;

a power relay including normally open contacts for coupling the microwave generating means to the external power supply and a relay coil adapted for energization by external power supply, said coil being operative when energized to close said normally open contacts;

said electronic arm switch means, said electronic latch means and said door switch means being operatively coupled to said relay coil such that energization of said coil is enabled only when each of said arm switch, latch and door switch means is in its first state;

whereby the selected time delay period is initiated by user actuation of said start switch means but energization of said power relay is prevented by said arm switch means until expiration of the time delay period.

3. A power control circuit arrangement for a microwave oven of the type having a cooking cavity enclosed on one side by a user access door and means enabling the user to select a time delay operating mode and delay and cooking times, said arrangement comprising:

a power circuit adapted for energization by an external power supply comprising at least one constant energization load to be energized constantly while a cooking cycle is in progress and a microwave generating means to be selectively periodically energized during a cooking cycle and an electronic power switch for controlling periodic energization of said microwave generating means; and a control circuit comprising:

a power control relay operative in a first operating condition to enable energization of said power circuit by said external power supply and in a second operating condition to prevent energization of said power circuit;

an electronic controller including timer means for controlling the duration of user selected delay times and cooking cycle times and operative to generate an arm signal upon expiration of a delay time to initiate a cooking cycle;

arm switch means responsive to said electronic controller and operative to assume a first state when said arm signal is present and assume a second state in the absence of said arm signal;

user actuable momentary start switch means;

door switch means responsive to the position of the oven access door operative to assume a first state when the door is closed and a second state when the door is open; and electronic latch means responsive to said start switch and said electronic controller having a first state and a second state operative to assure a first state only in response to user actuation of said start switch and to assume a second state in response to a reset signal from said controller;

said arm switch, said door switch and said latch means being operatively coupled to said relay such that said first operating condition of said relay is established only when each of said arm switch means, door switch means and latch means is in its first state; whereby energization of said power circuit occurs only when the start switch has been actuated, the door is closed and the selected delay time has expired.

4. The power control arrangement of claim 3 further comprising means for generating a door status signal having a first state when the said door switch and said latch means each is in its first state and a second state otherwise and wherein said electronic controller is responsive to said door status signal and operative to generate said reset signal when said door status signal switches from its first state to its second state; thereby resetting said latch means and deenergizing said relay coil, whereby energization of said power circuit is prevented when the access door is open and user actuation of said start switch subsequent to closing the door is required to resume energization of said power circuit.

* * * * *